US007024362B2

(12) United States Patent
Chu et al.

(10) Patent No.: US 7,024,362 B2
(45) Date of Patent: Apr. 4, 2006

(54) OBJECTIVE MEASURE FOR ESTIMATING MEAN OPINION SCORE OF SYNTHESIZED SPEECH

(75) Inventors: Min Chu, Beijing (CN); Hu Peng, Beijing (CN)

(73) Assignee: Microsoft Corporation, Redmond, WA (US)

( * ) Notice: Subject to any disclaimer, the term of this patent is extended or adjusted under 35 U.S.C. 154(b) by 584 days.

(21) Appl. No.: 10/073,427

(22) Filed: Feb. 11, 2002

(65) Prior Publication Data

US 2003/0154081 A1 Aug. 14, 2003

(51) Int. Cl.
*G10L 13/08* (2006.01)
*G10L 13/00* (2006.01)

(52) U.S. Cl. ..... 704/260; 704/258

(58) Field of Classification Search ..... 704/260, 704/258

See application file for complete search history.

(56) References Cited

U.S. PATENT DOCUMENTS

| | | | | |
|---|---|---|---|---|
| 5,634,086 | A * | 5/1997 | Rtischev et al. | 704/270 |
| 5,903,655 | A * | 5/1999 | Salmi et al. | 381/321 |
| 6,260,016 | B1 * | 7/2001 | Holm et al. | 704/260 |
| 6,370,120 | B1 * | 4/2002 | Hardy | 370/252 |
| 6,446,038 | B1 * | 9/2002 | Bayya et al. | 704/232 |
| 6,594,307 | B1 * | 7/2003 | Beerends | 375/224 |
| 6,609,092 | B1 * | 8/2003 | Ghitza et al. | 704/226 |
| 6,810,378 | B1 * | 10/2004 | Kochanski et al. | 704/258 |
| 2002/0173961 | A1 * | 11/2002 | Guerra | 704/258 |

OTHER PUBLICATIONS

Chu, M., Peng, H., "An Objective Measure for Estimating MOS of Synthesized Speech", Eurospeech 2001.*

Kitawaki, N., Nagabuchi, H., Itoh, K., "Objective Quality Evaluation for Low-Bit-Rate Speech Coding Systems", IEEE Journal on Selected Areas in Communications, vol. 6, No. 2, Feb. 1988.*

Wang, S., Sekey, A. and Gersho A. (1992), An Objective Measure for Predicting Subjective Quality of Speech Coders:, IEEE Journal on selected areas on communications, vol. 10, Issue 5, 819-829.*

Dimolitsas, S. "Objective Speech Distortion Measures and their Relevance to Speech Quality Assessments", IEEE Proceedings, vol. 136, Pt. I, No. 5, Oct. 1989, 317-324.*

Cotainis, L. (2000), "Speech Quality Evaluation for Mobile Networks", Proceedings of 20000 IEEE International Conference on Communication, vol. 3, 1530-1534.*

(Continued)

*Primary Examiner*—W. R. Young
*Assistant Examiner*—Matthew J. Sked
(74) *Attorney, Agent, or Firm*—Steven M. Koehler; Westman, Champlin, & Kelly, P.A.

(57) ABSTRACT

A method for estimating mean opinion score or naturalness of synthesized speech is provided. The method includes using an objective measure that has components derived directly from textual information used to form synthesized utterances. The objective measure has a high correlation with mean opinion score such that a relationship can be formed between the objective measure and corresponding mean opinion score. An estimated mean opinion score can be obtained easily from the relationship when the objective measure is applied to utterances of a modified speech synthesizer.

29 Claims, 6 Drawing Sheets

OTHER PUBLICATIONS

Thorpe, L., Yang, W., (1999) "Performance of Current Perceptual Objective Speech Quality Measures", Proceeding of IEEE Workshop on Speech Coding, 1999, 144-146.*

Bayya, A. and Vis, M., Objective Measures for Speech Quality Assessment in Wireless Communications:, Proceedings of ICASSP 96, vol. I, 495-498.*

Kitawaki, N., Nagabuchi, H., "Quality Assessment of Speech Coding and Speech Synthesis Systems", Communications Magazine, IEEE, vol. 26, Issue 10, Oct. 1988, 36-44.*

Hagen, R. Paksoy, E. Gersho, A. "Voicing-Specific LPC Quantization for Variable-Rate Speech Coding", IEEE transactions on speech and audio processing, vol. 1, No. 5, Sep. 1999.*

Bou-Ghazale, S. Hansen, J. "HMM-Based Stressed Speech Modeling with Application to Improved Synthesis and Recognition of Isolated Speech Under Stress", IEE transactions on speech and audio processsing, vol. 6, No. 3, May 1998.*

Wu, S. Pols, L. "A Distance Measure for Objective Quality Evaluation of Speech Communication Channels Using Also Dynamic Spectral Features", Institute of Phonetic Services, Proceedings 20, pp. 27-42, 1996.*

* cited by examiner

OBJECTIVE MEASURE FOR ESTIMATING MEAN OPINION SCORE OF SYNTHESIZED SPEECH

BACKGROUND OF THE INVENTION

The present invention relates to speech synthesis. In particular, the present invention relates to an objective measure for estimating naturalness of synthesized speech.

Text-to-speech technology allows computerized systems to communicate with users through synthesized speech. The quality of these systems is typically measured by how natural or human-like the synthesized speech sounds.

Very natural sounding speech can be produced by simply replaying a recording of an entire sentence or paragraph of speech. However, the complexity of human languages and the limitations of computer storage may make it impossible to store every conceivable sentence that may occur in a text. Instead, systems have been developed to use a concatenative approach to speech synthesis. This concatenative approach combines stored speech samples representing small speech units such as phonemes, diphones, triphones, syllables or the like to form a larger speech signal unit.

Evaluating the quality of synthesized speech contains two aspects, intelligibility and naturalness. Generally, intelligibility is not a large concern for most text-to-speech systems. However, the naturalness of synthesized speech is a larger issue and is still far from most expectations.

During text-to-speech system development, it is necessary to have regular evaluations on a naturalness of the system. The Mean Opinion Score (MOS) is one of the most popular and widely accepted subjective measures for naturalness. However, running a formal MOS evaluation is expensive and time consuming. Generally, to obtain a MOS score for a system under consideration, a collection of synthesized waveforms must be obtained from the system. The synthesized waveforms, together with some waveforms generated from other text-to-speech systems and/or waveforms uttered by a professional announcer are randomly played to a set of subjects. Each of the subjects are asked to score the naturalness of each waveform from 1–5 (1=bad, 2=poor, 3=fair, 4=good, 5=excellent). The means of the scores from the set of subjects for a given waveform represents naturalness in a MOS evaluation.

In view of the difficulties in obtaining MOS scores, it would thus be desirable to be able to objectively measure the naturalness of synthesized speech. By estimating naturalness through an objective measure, system development would be greatly enhanced since algorithmic changes in the system could be more quickly ascertained. In addition, databases storing the speech units could also be pruned efficiently to scale the system to the computer's resources, while maintaining desired naturalness.

SUMMARY OF THE INVENTION

A method for estimating mean opinion score or naturalness of synthesized speech is provided. The method includes using an objective measure that has components derived directly from textual information used to form synthesized utterances. The objective measure has a high correlation with mean opinion score such that a relationship can be formed between the objective measure and corresponding mean opinion score. An estimated mean opinion score can be obtained easily from the relationship when the objective measure is applied to utterances of a modified speech synthesizer.

The objective measure can be based on one or more factors of the speech units used to create the utterances. The factors can include the position of the speech unit in a phrase or word, the neighboring phonetic or tonal context, the prosodic mismatch of successive speech units or the stress level of the speech unit. Weighting factors can be used since correlation of the factors with mean opinion score has been found to vary between the factors.

By using the objective measure it is easy to track performance in naturalness of the speech synthesizer, thereby allowing efficient development of the speech synthesizer. In particular, the objective measure can serve as criteria for optimizing the algorithms for speech unit selection and speech database pruning.

DETAILED DESCRIPTION OF ILLUSTRATIVE EMBODIMENT

Figure 1:
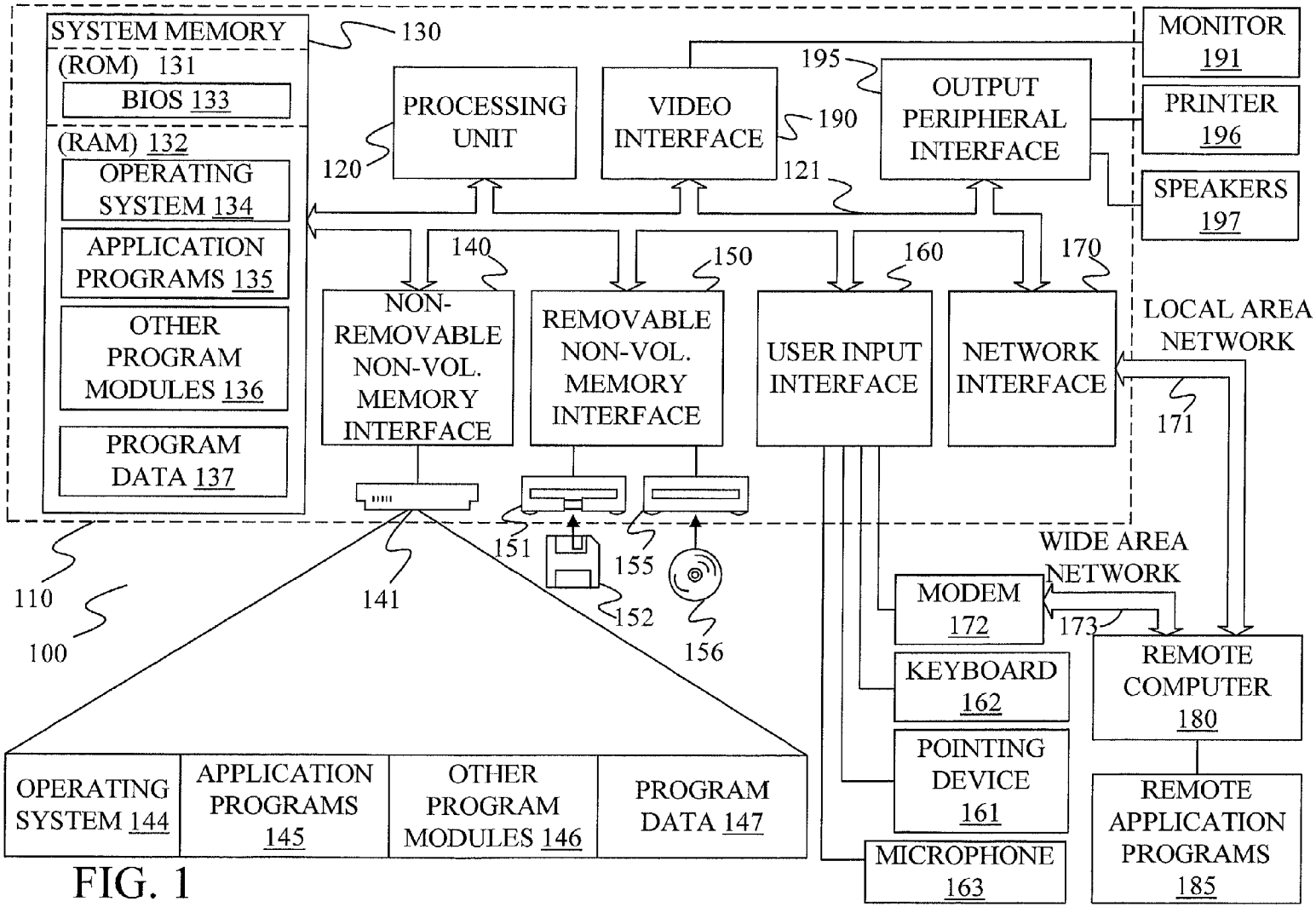
FIG. 1 is a block diagram of a general computing environment in which the present invention may be practiced.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. Tasks performed by the programs and modules are described below and with the aid of figures. Those skilled in the art can implement the description and figures as processor executable instructions, which can be written on any form of a computer readable media.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 100.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, FR, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 190.

The computer 110 may operate in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
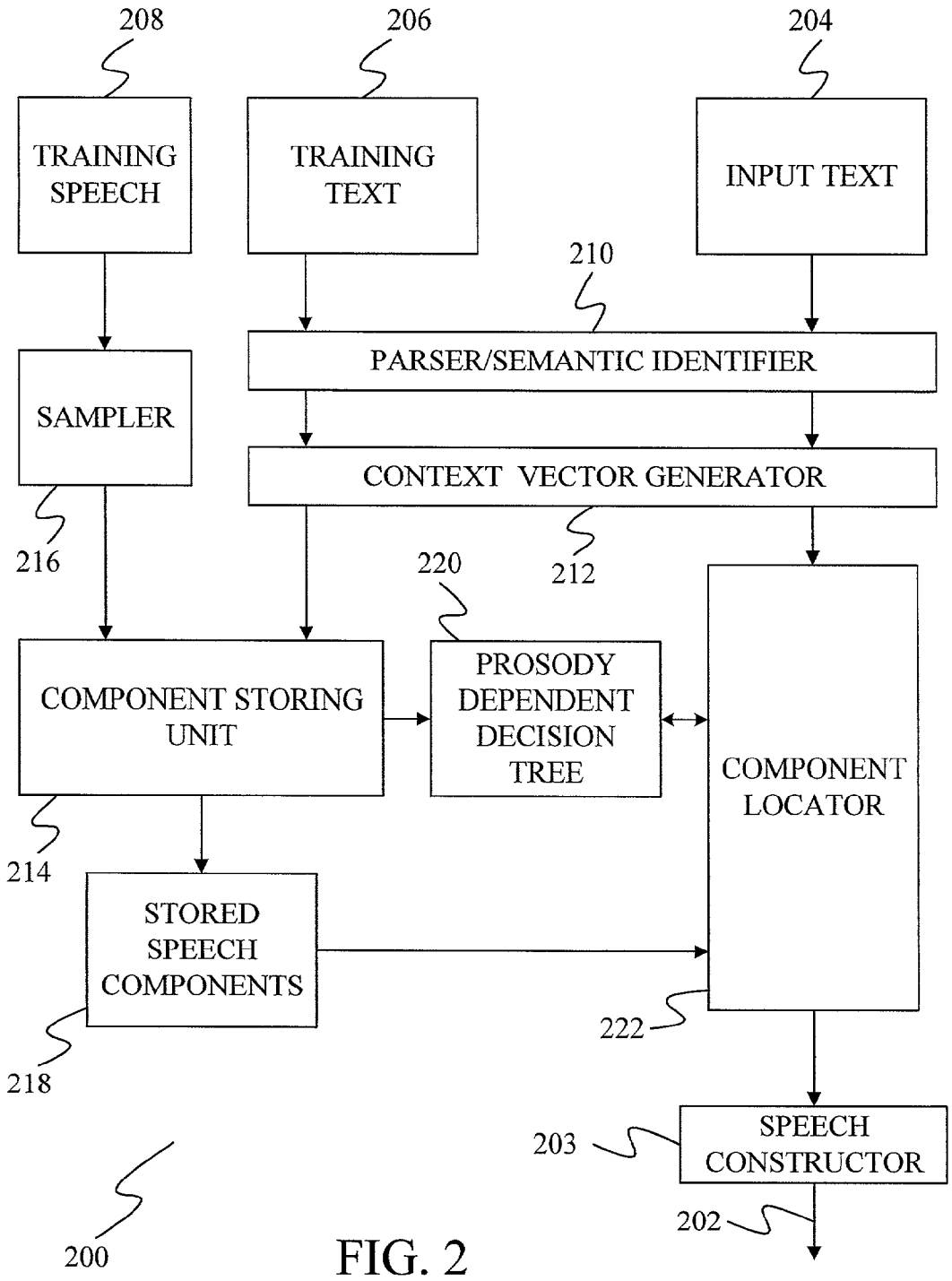
FIG. 2 is a block diagram of a speech synthesis system.

To further help understand the usefulness of the present invention, it may helpful to provide a brief description of a speech synthesizer 200 illustrated in FIG. 2. However, it should be noted that the synthesizer 200 is provided for exemplary purposes and is not intended to limit the present invention.

FIG. 2 is a block diagram of speech synthesizer 200, which is capable of constructing synthesized speech 202 from input text 204. In conventional concatenative TTS systems, a pitch and duration modification algorithm, such as PSOLA, is applied to pre-stored units to guarantee that the prosodic features of synthetic speech meet the predicted target values. These systems have the advantages of flexibility in controlling the prosody. Yet, they often suffer from significant quality decrease in naturalness. In the TTS system 200, speech is generated by directly concatenating syllable segments (speech units) without any pitch or duration modification under the assumption that the speech database contains enough prosodic and spectral varieties for all synthetic units and the best fitting segments can always be found.

However, before speech synthesizer 200 can be utilized to construct speech 202, it must be initialized with samples of speech units taken from a training text 206 that are read into speech synthesizer 200 as training speech 208.

Initially, training text 206 is parsed by a parser/semantic identifier 210 into strings of individual speech units. Under some embodiments of the invention, especially those used to form Chinese speech, the speech units are tonal syllables. However, other speech units such as phonemes, diphones, or triphones may be used within the scope of the present invention.

Parser/semantic identifier 210 also identifies high-level prosodic information about each sentence provided to the parser 210. This high-level prosodic information includes the predicted tonal levels for each speech unit as well as the grouping of speech units into prosodic words and phrases. In embodiments where tonal syllable speech units are used, parser/semantic identifier 210 also identifies the first and last phoneme in each speech unit.

The strings of speech units produced from the training text 206 are provided to a context vector generator 212, which generates a Speech unit-Dependent Descriptive Contextual Variation Vector (SDDCVV, hereinafter referred to as a "context vector"). The context vector describes several context variables that can affect the naturalness of the speech unit. Under one embodiment, the context vector describes six variables or coordinates of textual information. They are:

Position in phrase: the position of the current speech unit in its carrying prosodic phrase.

Position in word: the position of the current speech unit in its carrying prosodic word.

Left phonetic context: category of the last phoneme in the speech unit to the left (preceding) of the current speech unit.

Right phonetic context: category of the first phoneme in the speech unit to the right (following) of the current speech unit.

Left tone context: the tone category of the speech unit to the left (preceding) of the current speech unit.

Right tone context: the tone category of the speech unit to the right (following) of the current speech unit.

If desired, the coordinates of the context vector can also include the stress level of the current speech unit or the coupling degree of its pitch, duration and/or energy with its neighboring units.

Under one embodiment, the position in phrase coordinate and the position in word coordinate can each have one of four values, the left phonetic context can have one of eleven values, the right phonetic context can have one of twenty-six values and the left and right tonal contexts can each have one of two values.

The context vectors produced by context vector generator 212 are provided to a component storing unit 214 along with speech samples produced by a sampler 216 from training speech signal 208. Each sample provided by sampler 216 corresponds to a speech unit identified by parser 210. Component storing unit 214 indexes each speech sample by its context vector to form an indexed set of stored speech components 218.

The samples are indexed, for example, by a prosody-dependent decision tree (PDDT), which is formed automatically using a classification and regression tree (CART). CART provides a mechanism for selecting questions that can be used to divide the stored speech components into small groups of similar speech samples. Typically, each question is used to divide a group of speech components into two smaller groups. With each question, the components in the smaller groups become more homogenous. Grouping of the speech units is not directly pertinent to the present invention and a detailed discussion for forming the decision tree is provided in co-pending application "METHOD AND APPARATUS FOR SPEECH SYNTHESIS WITHOUT PROSODY MODIFICATION", filed May 7, 2001 and assigned Ser. No. 09/850,527.

Generally, when the decision tree is in its final form, each leaf node will contain a number of samples for a speech unit. These samples have slightly different prosody from each other. For example, they may have different phonetic contexts or different tonal contexts from each other. By maintaining these minor differences within a leaf node, the speech synthesizer 200 introduces slight diversity in prosody, which is helpful in removing monotonous prosody. A set of stored speech samples 218 is indexed by decision tree 220. Once created, decision tree 220 and speech samples 218 can be used to generate concatenative speech without requiring prosody modification.

The process for forming concatenative speech begins by parsing input text 204 using parser/semantic identifier 210 and identifying high-level prosodic information for each speech unit produced by the parse. This prosodic information is then provided to context vector generator 212, which generates a context vector for each speech unit identified in the parse. The parsing and the production of the context vectors are performed in the same manner as was done during the training of prosody decision tree 220.

The context vectors are provided to a component locator 222, which uses the vectors to identify a set of samples for the sentence. Under one embodiment, component locator 222 uses a multi-tier non-uniform unit selection algorithm to identify the samples from the context vectors.

Figure 3:
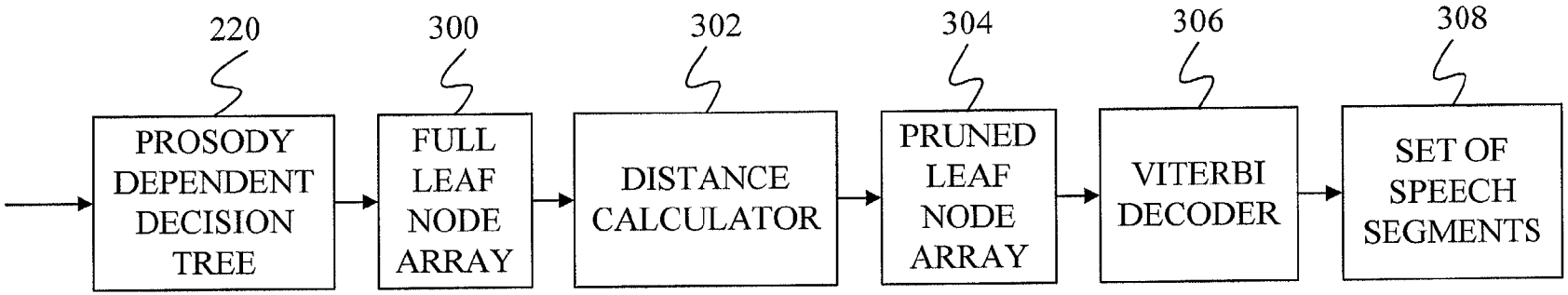
FIG. 3 is a block diagram of a selection system for selecting speech segments.
Figure 4:
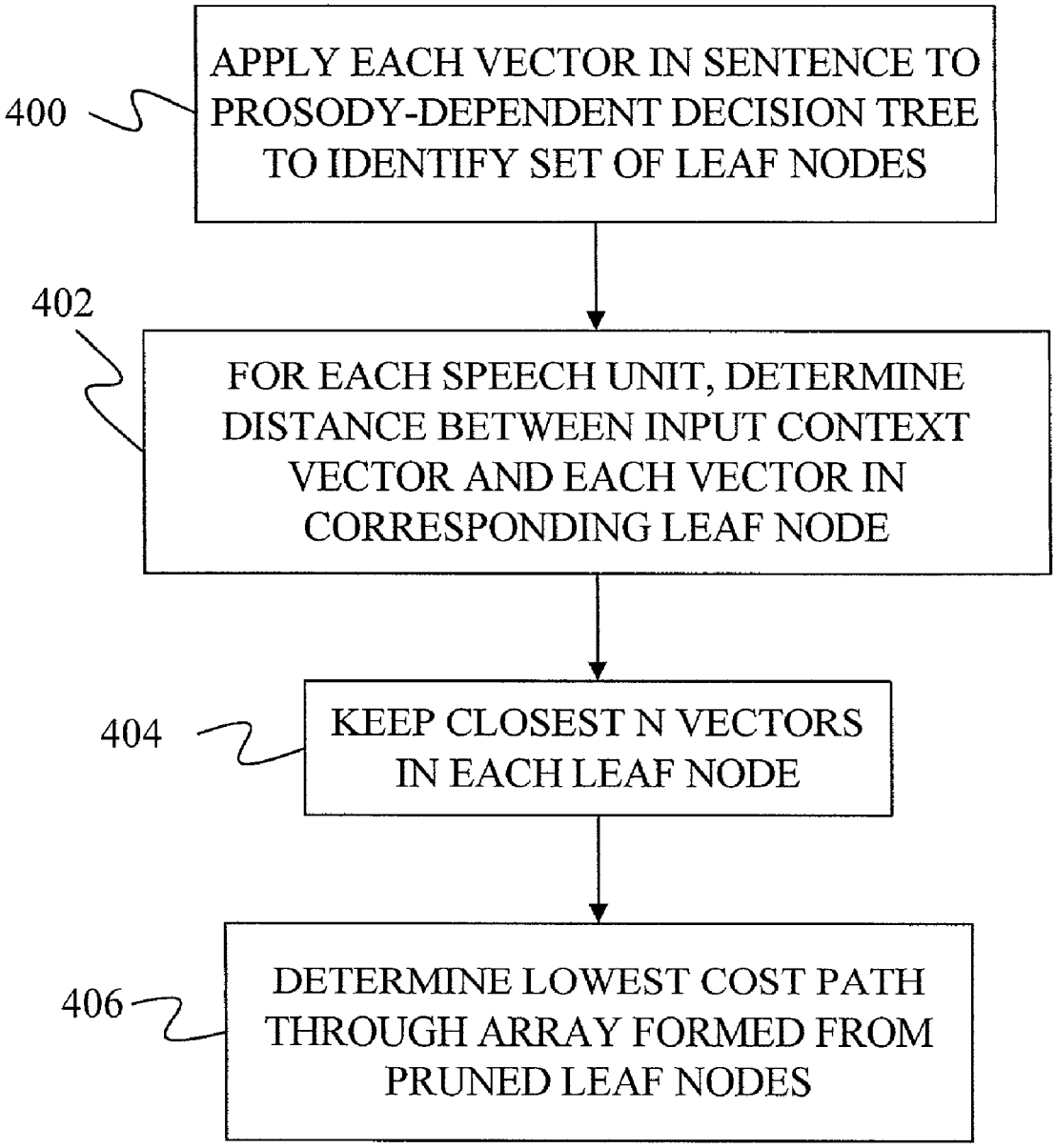
FIG. 4 is a flow diagram of a selection system for selecting speech segments.

FIGS. 3 and 4 provide a block diagram and a flow diagram for a multi-tier non-uniform selection algorithm. In step 400, each vector in the set of input context vectors is applied to prosody-dependent decision tree 220 to identify a leaf node array 300 that contains a leaf node for each context vector. At step 402, a set of distances is determined by a distance calculator 302 for each input context vector. In particular, a separate distance is calculated between the input context vector and each context vector found in its respective leaf node. Under one embodiment, each distance is calculated as:

$$D_c = \sum_{i=1}^{I} W_{ci} D_i \quad \text{EQ. 1}$$

where $D_c$ is the context distance, $D_i$ is the distance for coordinate i of the context vector, $W_{ci}$ is a weight associated with coordinate i, and I is the number of coordinates in each context vector.

At step 404, the N samples with the closest context vectors are retained while the remaining samples are pruned from node array 300 to form pruned leaf node array 304. The number of samples, N, to leave in the pruned nodes is determined by balancing improvements in prosody with improved processing time. In general, more samples left in the pruned nodes means better prosody at the cost of longer processing time.

At step 406, the pruned array is provided to a Viterbi decoder 306, which identifies a lowest cost path through the pruned array. Although the sample with the closest context vector in each node could be selected, using a multi-tier approach, the cost function is:

$$C_c = W_c \sum_{j=1}^{J} D_{cj} + W_s \sum_{j=1}^{J} C_{sj} \quad \text{EQ. 2}$$

where $C_c$ is the concatenation cost for the entire sentence or utterance, $W_c$ is a weight associated with the distance measure of the concatenated cost, $D_{cj}$ is the distance calculated in equation 1 for the $j^{th}$ speech unit in the sentence, $W_s$ is a weight associated with a smoothness measure of the concatenated cost, $C_{sj}$ is a smoothness cost for the $j^{th}$ speech unit, and J is the number of speech units in the sentence.

The smoothness cost in Equation 2 is defined to provide a measure of the prosodic mismatch between sample j and the samples proposed as the neighbors to sample j by the Viterbi decoder. Under one embodiment, the smoothness cost is determined based on whether a sample and its neighbors were found as neighbors in an utterance in the training corpus. If a sample occurred next to its neighbors in the training corpus, the smoothness cost is zero since the samples contain the proper prosody to be combined together. If a sample did not occur next to its neighbors in the training corpus, the smoothness cost is set to one.

Using the multi-tier non-uniform approach, if a large block of speech units, such as a word or a phrase, in the input text exists in the training corpus, preference will be given to selecting all of the samples associated with that block of speech units. Note, however, that if the block of speech units occurred within a different prosodic context, the distance between the context vectors will likely cause different samples to be selected than those associated with the block.

Once the lowest cost path has been identified by Viterbi decoder 306, the identified samples 308 are provided to speech constructor 203. With the exception of small amounts of smoothing at the boundaries between the speech units, speech constructor 203 simply concatenates the speech units to form synthesized speech 202.

It has been discovered by the inventors that the evaluation of concatenative cost can form the basis of an objective measure for MOS estimation.

Figure 5:
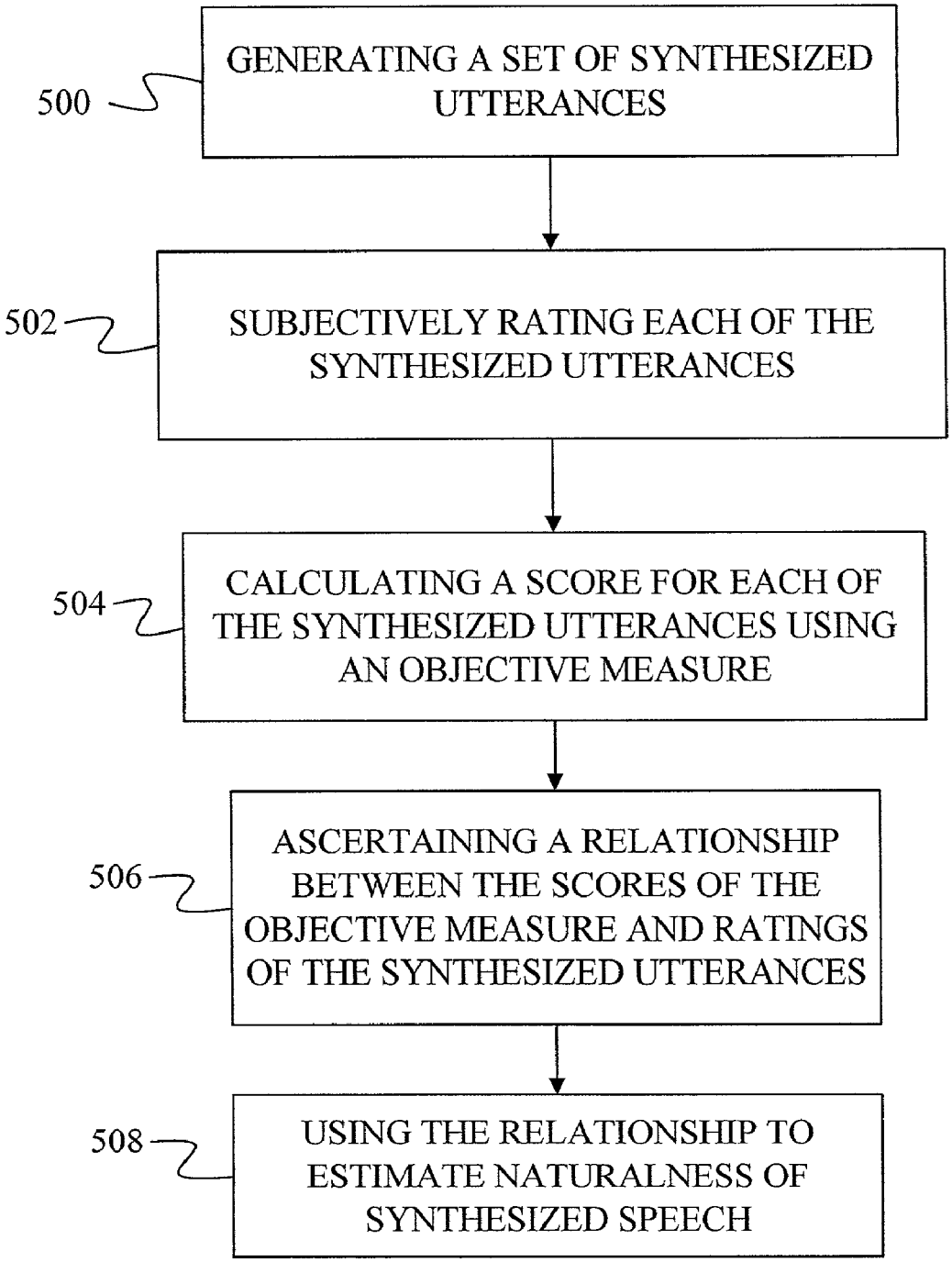
FIG. 5 is a flow diagram for estimating mean opinion score from an objective measure.

A method for using the objective measure in estimating MOS is illustrated in FIG. 5. Generally, the method includes generating a set of synthesized utterances at step 500, and subjectively rating each of the utterances at step 502. A score is then calculated for each of the synthesized utterances using the objective measure at step 504. The scores from the objective measure and the ratings from the subjective analysis are then analyzed to determine a relationship at step 506. The relationship is used at step 508 to estimate naturalness or MOS when the objective measure is applied to the textual information of speech units for another utterance or second set of utterances from a modified speech synthesizer (e.g. when a parameter of the speech synthesizer has been changed). It should be noted that the words of the "another utterance" or the "second set of utterances" obtained from the modified speech synthesizer can be the same or different words used in the first set of utterances.

In one embodiment, in order to make the concatenative cost comparable among utterances with variable number of syllables, the average concatenative cost of an utterance is used and can be expressed as:

$$C_a = \sum_{i=1}^{I+1} W_i C_{ai}$$

$$C_{ai} = \begin{cases} \frac{1}{J} \sum_{l=1}^{J} D_t(l), & i = 1, \cdots, I \\ \frac{1}{J-1} \sum_{l=1}^{J-1} C_s(l), & i = I+1 \end{cases}$$

$$W_i = \begin{cases} W_{ci} W_c & 1 = 1, \cdots, I \\ W_s & i = I+1 \end{cases}$$

where, $C_a$ is the average concatenative cost and $C_{ai}$ (i=1, . . . , 7) one or more of the factors that contribute to $C_a$, which are, in the illustrative embodiment, the average costs for position in phrase, position in word, left phonetic context, right phonetic context, left tone context, right tone context and smoothness. $W_i$ are weights for the seven component-costs and all are set to 1, but can be changed. For instance, it has been found that the coordinate having the highest correlation with mean opinion score was smoothness, whereas the lowest correlation with mean opinion score was position in phase. It is therefore reasonable to assign larger weights for components with high correlation and smaller weights for components with low correlation. In one experiment, the following weights were used:

Position in Phrase, $W_1$=0.10
Position in Word, $W_2$=0.60
Left Phonetic Context, $W_3$=0.10
Right Phonetic Context, $W_4$=0.76
Left Tone Context, $W_5$=1.76
Right Tone Context, $W_6$=0.72
Smoothness, $W_7$=2.96

In one exemplary embodiment, 100 sentences are carefully selected from a 200 MB text corpus so the $C_a$ and $C_{ai}$ (i=1, . . . , 7) of them are scattered into wide spans. Four synthesized waveforms are generated for each sentence with the speech synthesizer 200 above with four speech databases, whose sizes are 1.36 GB, 0.9 GB, 0.38 GB and 0.1 GB, respectively. $C_a$ and $C_{ai}$ of each waveform are calculated. All the 400 synthesized waveforms, together with some waveforms generated from other TTS systems and waveforms uttered by a professional announcer, are randomly played to 30 subjects. Each of the subjects is asked to score the naturalness of each waveform from 1-5 (1=bad, 2=poor, 3=fair, 4=good, 5=excellent). The mean of the thirty scores for a given waveform represents its naturalness in MOS.

Fifty original waveforms uttered by the speaker who provides voice for the speech database are used in this example. The average MOS for these waveforms was 4.54, which provides an upper bound for MOS of synthetic voice. Providing subjects a wide range of speech quality by adding waveforms from other systems can be helpful so that the subjects make good judgements on naturalness. However, only the MOS for the 400 waveforms generated by the speech synthesizer under evaluation are used in conjunction with the corresponding average concatenative cost score.

Figure 6:
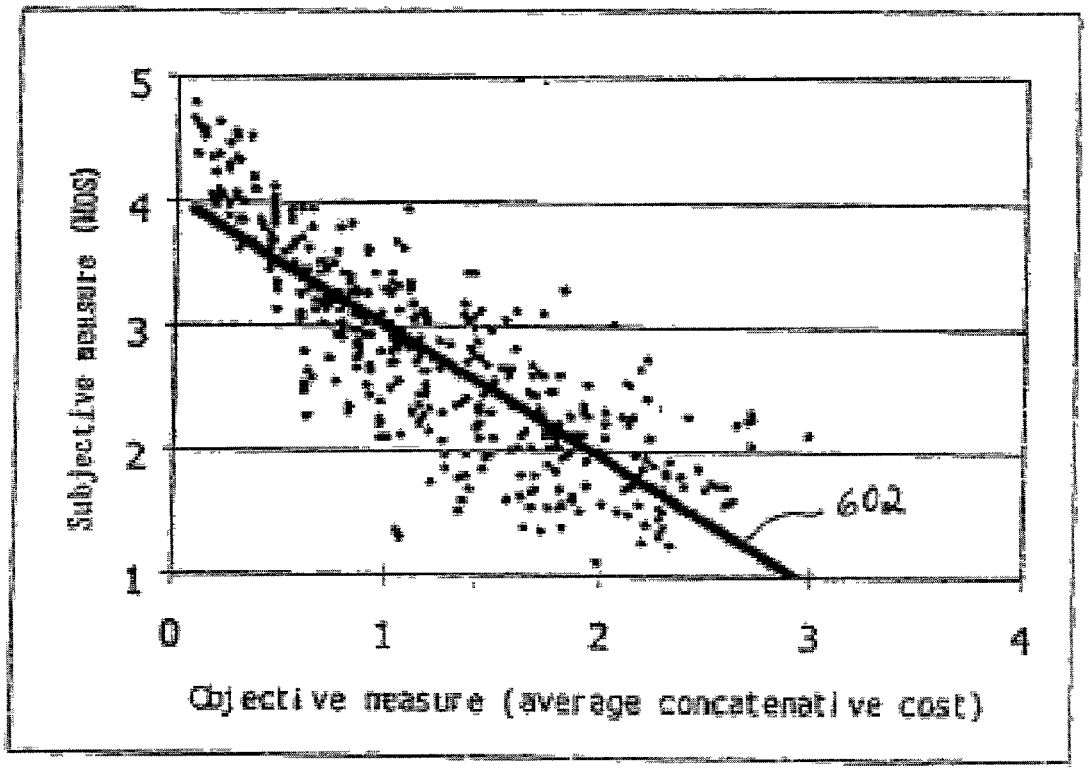
FIG. 6 is a plot of a relationship between mean opinion score and the objective measure.

FIG. 6 is a plot illustrating the objective measure (average concatenative cost) versus subjective measure (MOS) for the 400 waveforms. A correlation coefficient between the two dimensions is −0.822, which reveals that the average concatenative cost function replicates, to a great extent, the perceptual behavior of human beings. The minus sign of the coefficient means that the two dimensions are negatively correlated. The larger $C_a$ is, the smaller the corresponding MOS will be. A linear regression trendline 602 is illustrated in FIG. 6 and is estimated by calculating the least squares fit throughout points. The trendline or curve is denoted as the average concatenative cost-MOS curve and for the exemplary embodiment is:

$$Y=-1.0327x+4.0317.$$

However, it should be noted that analysis of the relationship of average concatenative cost and MOS score for the representative waveforms can also be performed with other curve-fitting techniques, using, for example, higher-order polynomial functions. Likewise, other techniques of correlating average concatenative cost and MOS can be used. For instance, neural networks and decision trees can also be used.

Using the average concatenative cost vs. MOS relationship, an estimate of MOS for a single synthesized speech waveform can be obtained by its average concatenative cost. Likewise, an estimate of the average MOS for a TTS system can be obtained from the average of the average of the concatenative costs that are calculated over a large amount of synthesized speech waveforms. In fact, when calculating the average concatenative cost, it is unnecessary to generate the speech waveforms since the costs can be calculated after the speech units have been selected.

Although the present invention has been described with reference to particular embodiments, workers skilled in the art will recognize that changes may be made in form and detail without departing from the spirit and scope of the invention. In particular, although context vectors are discussed above, other representations of the context information sets may be used within the scope of the present invention.

What is claimed is:

1. A method for estimating naturalness of synthesized speech, wherein naturalness is a subjective quality of synthesized speech, the method comprising:

generating a set of synthesized utterances from textual information;

subjectively rating each of the synthesized utterances;

calculating a score for each of the synthesized utterances using an objective measure, the objective measure being a function of textual information used to form the utterances;

ascertaining a relationship between the scores of the objective measure and subjective ratings of the synthesized utterances; and using the relationship to estimate naturalness of synthesized speech.

2. The method of claim 1, wherein the objective measure is a function of a concatenative cost of the textual information used to form words in the utterances.

3. The method of claim 2, wherein the objective measure comprises an indication of a position of a speech unit in a phrase.

4. The method of claim 2, wherein the objective measure comprises an indication of a position of a speech unit in a word.

5. The method of claim 2, wherein the objective measure comprises an indication of a category for a phoneme preceding a speech unit.

6. The method of claim 2, wherein the objective measure comprises an indication of a category for a phoneme following a speech unit.

7. The method of claim 2, wherein the objective measure comprises an indication of a category for the tone of a preceding speech unit.

8. The method of claim 2, wherein the objective measure comprises an indication of a category for the tone of a following speech unit.

9. The method of claim 2, wherein the objective measure comprises an indication of a prosodic mismatch between successive speech units.

10. The method of claim 2, wherein the objective measure comprises an indication of level of stress of a speech unit.

11. The method of claim 2, wherein the objective measure score for each synthesized utterance is a function of a length of said each synthesized utterance.

12. The method of claim 11, wherein the length comprises a number of speech units in an utterance.

13. The method of claim 2, wherein calculating a score includes generating context vectors for each synthesized utterance wherein the context vectors comprise at least two coordinates of textual information from a set including:

an indication of a position of a speech unit in a phrase;

an indication of a position of a speech unit in a word;

an indication of a category for a phoneme preceding a speech unit;

an indication of a category for a phoneme following a speech unit;

an indication of a category for the tone of a preceding speech unit;

an indication of a category for the tone of a following speech unit; and an indication of a level of stress of a speech unit; and an indication of a degree of coupling with a neighboring speech unit.

14. The method of claim 13, wherein calculating a score includes generating context vectors for each of the synthesized utterances wherein the context vectors comprise at least three coordinates of textual information from the set.

15. The method of claim 13, wherein calculating a score includes generating context vectors for each of the synthesized utterances wherein the context vectors comprise at least four coordinates of textual information from the set.

16. The method of claim 13, wherein calculating a score includes generating context vectors for each of the synthesized utterances wherein the context vectors comprise at least six coordinates of textual information from the set.

17. The method of claim 13, wherein the objective measure includes an indication of prosodic mismatch of successive speech units.

18. The method of claim 13, wherein the coordinates are weighted.

19. A method for developing a speech synthesizer, the method comprising:

obtaining a set of synthesized utterances based on textual information from the speech synthesizer;

subjectively rating naturalness of each of the synthesized utterances;

calculating a score for each of the synthesized utterances using an objective measure, the objective measure being a function of textual information of speech units for each of the utterances;

ascertaining a relationship between the scores of the objective measure and ratings of the synthesized utterances;

varying a parameter of the speech synthesizer;

obtaining speech units for another utterance after the parameter of the speech synthesizer has been varied; and calculating a second score for said another utterance using the objective measure; and using the relationship and the second score to estimate naturalness of said another utterance.

20. The method of claim 19, wherein the objective measure is a function of a concatenative cost of the textual information used to form a word in each utterance.

21. The method of claim 20, wherein obtaining speech units for another utterance includes obtaining speech units for a second set of utterances, wherein calculating a second score includes calculating corresponding scores for each of the utterances of the second set of utterances, and wherein using the relationship includes using the relationship to estimate naturalness of each of said second set of utterances.

22. The method of claim 20, wherein the parameter comprises an amount of speech units available for synthesis.

23. The method of claim 20, wherein the parameter comprises an algorithm for selecting speech units.

24. The method of claim 20, wherein calculating a score includes generating context vectors for each synthesized utterance wherein the context vectors comprise at least two coordinates of textual information from a set including:

an indication of a position of a speech unit in a phrase;

an indication of a position of a speech unit in a word;

an indication of a category for a phoneme preceding a speech unit;

an indication of a category for a phoneme following a speech unit;

an indication of a category for the tone of a preceding speech unit;

an indication of a category for a tone of a following speech unit; and an indication of a level of stress of a speech unit.

25. The method of claim 24, wherein calculating a score includes generating context vectors for each of the synthesized utterances wherein the context vectors comprise at least three coordinates of textual information from the set.

26. The method of claim 24, wherein calculating a score includes generating context vectors for each of the synthesized utterances wherein the context vectors comprise at least four coordinates of textual information from the set.

27. The method of claim 24, wherein calculating a score includes generating context vectors for each of the synthesized utterances wherein the context vectors comprise at least five coordinates of textual information from the set.

28. The method of claim 24, wherein the objective measure includes an indication of prosodic mismatch of successive speech units.

29. The method of claim 24, wherein the coordinates are weighted.

* * * * *